United States Patent [19]

Matson et al.

[11] Patent Number: 4,794,995

[45] Date of Patent: Jan. 3, 1989

[54] ORIENTABLE FLUID NOZZLE FOR DRILL BITS

[75] Inventors: Lawrence W. Matson, League City; Stephen G. Southland, Houston; Roy T. Jackson, Missouri City, all of Tex.

[73] Assignee: Diamant Boart-Statabit (USA) Inc., Houston, Tex.

[21] Appl. No.: 111,580

[22] Filed: Oct. 23, 1987

[51] Int. Cl.[4] ..... E21B 10/60

[52] U.S. Cl. ..... 175/393; 81/176.1; 175/340; 175/424; 239/600; 411/406

[58] Field of Search ..... 175/393, 340, 339, 424; 239/600, 591; 29/240; 81/176.1, 176.15, 176.2, 124.2, 53.2; 411/406, 405, 403, 402, 1; 285/139, 330; 403/381

[56] References Cited

U.S. PATENT DOCUMENTS

| | | | |
|---|---|---|---|
| 805,072 | 11/1905 | Jackson | 81/176.15 X |
| 1,453,913 | 5/1923 | Burdick | 29/240 X |
| 3,131,779 | 5/1964 | Rowley et al. | 175/393 |
| 3,695,321 | 10/1972 | Garehime, Jr. | 411/403 X |
| 4,381,825 | 5/1983 | Radtke | 175/393 |
| 4,400,024 | 8/1983 | Ratcliff et al. | 175/340 X |
| 4,533,005 | 8/1985 | Morris | 175/393 |
| 4,542,798 | 9/1985 | Madigan | 175/393 X |
| 4,582,149 | 4/1986 | Slaughter, Jr. | 175/340 |

FOREIGN PATENT DOCUMENTS

| | | | |
|---|---|---|---|
| 500053 | 3/1976 | U.S.S.R. | 81/176.15 |

*Primary Examiner*—Hoang C. Dang

*Attorney, Agent, or Firm*—Burns, Doane, Swecker & Mathis

[57] ABSTRACT

A nozzle for a drill bit comprises a nozzle body and a ring for securing the nozzle body in a threaded cavity of the drill bit. The nozzle body includes a fluid passage of the orientable type. The ring comprises an externally threaded sleeve and a cap bonded to a front end thereof. The cap and nozzle body are formed of harder materials than the threaded sleeve. The cap contains dove-tail shaped slots for receiving complementarily shaped projections on a tool to enable the ring to be rotated relative to the nozzle body. By threading the ring into the cavity, the nozzle body can be secured in the cavity with its fluid passage oriented in the desired final orientation.

7 Claims, 2 Drawing Sheets

Fig. 1
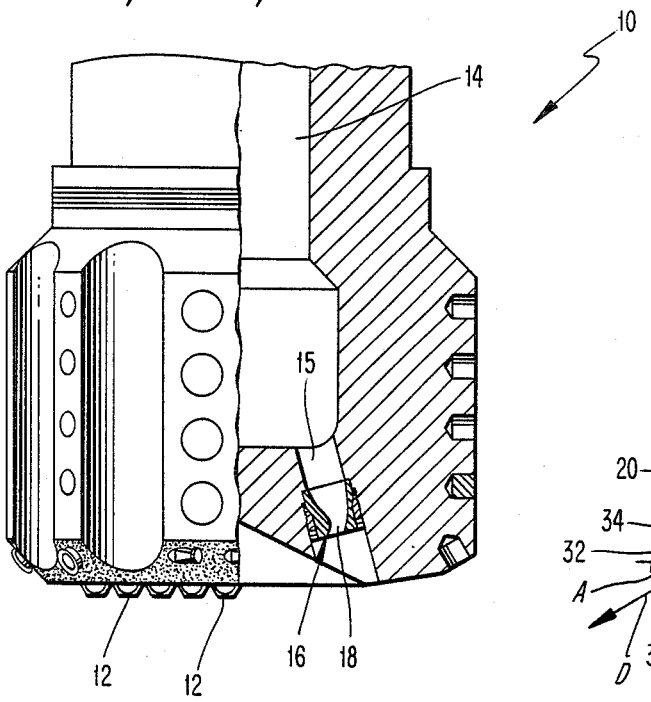
Fig. 2
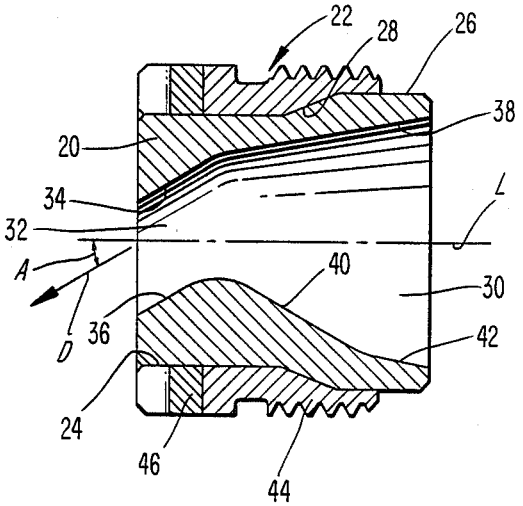
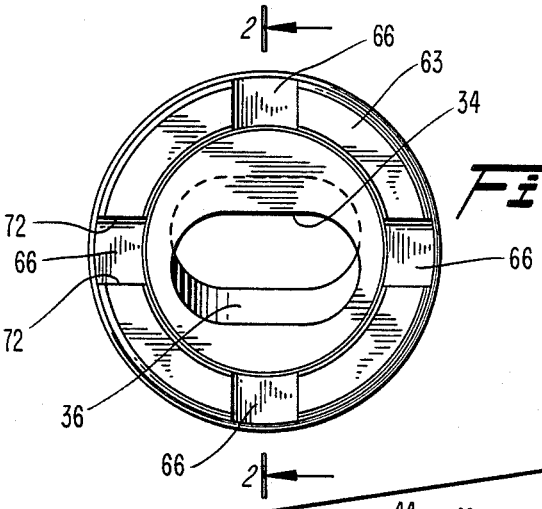
Fig. 3
Fig. 4
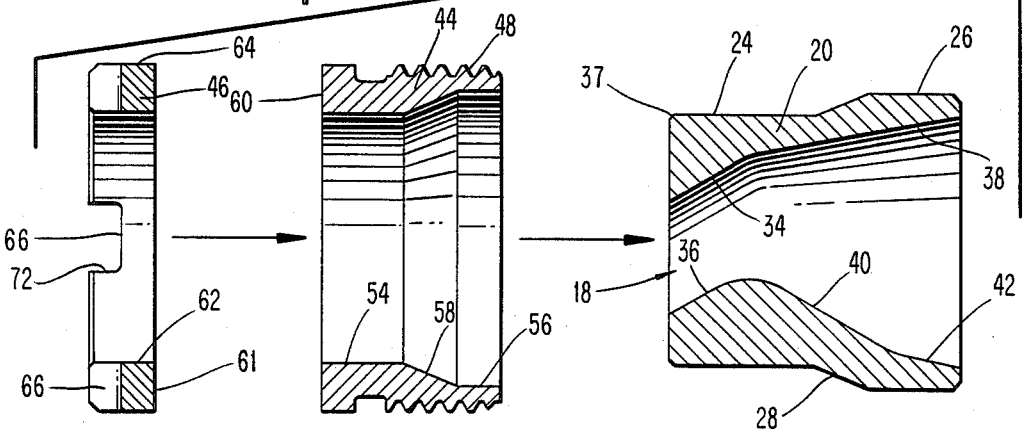

Fig. 5
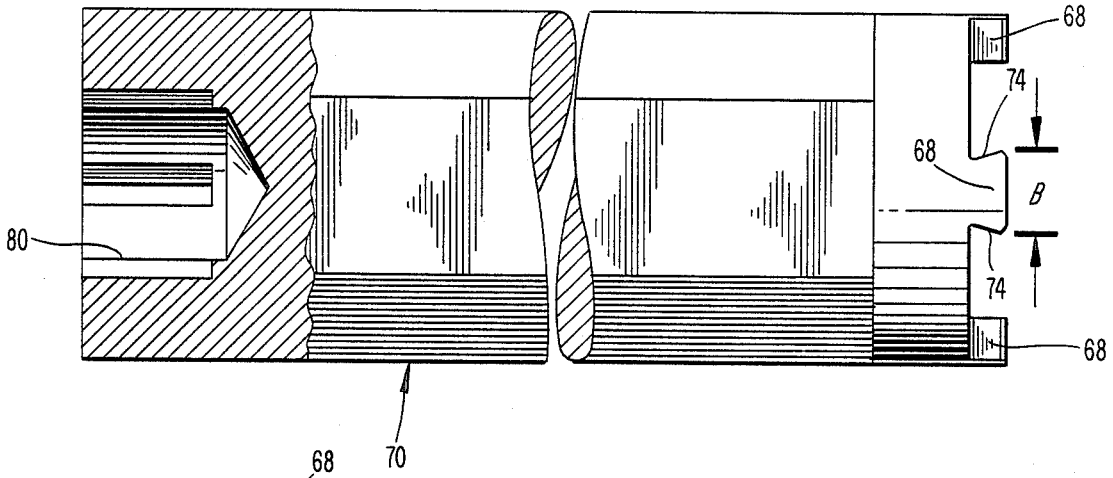
Fig. 6
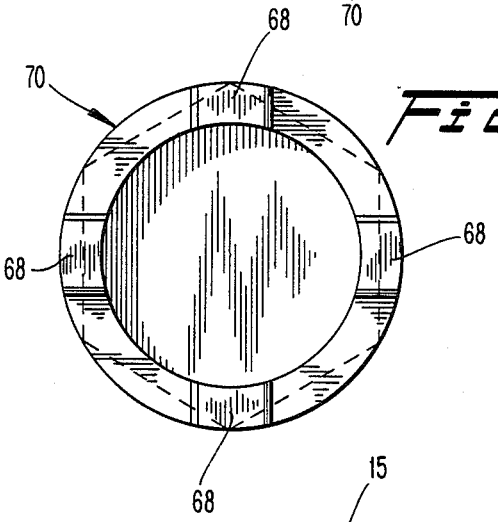
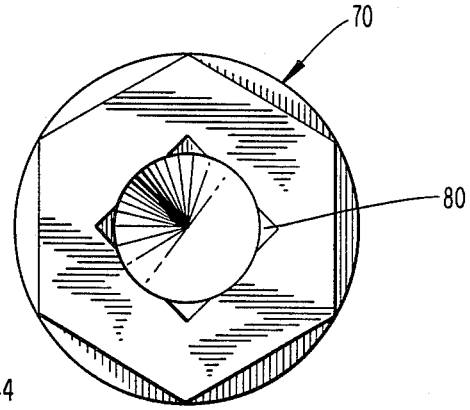
Fig. 7
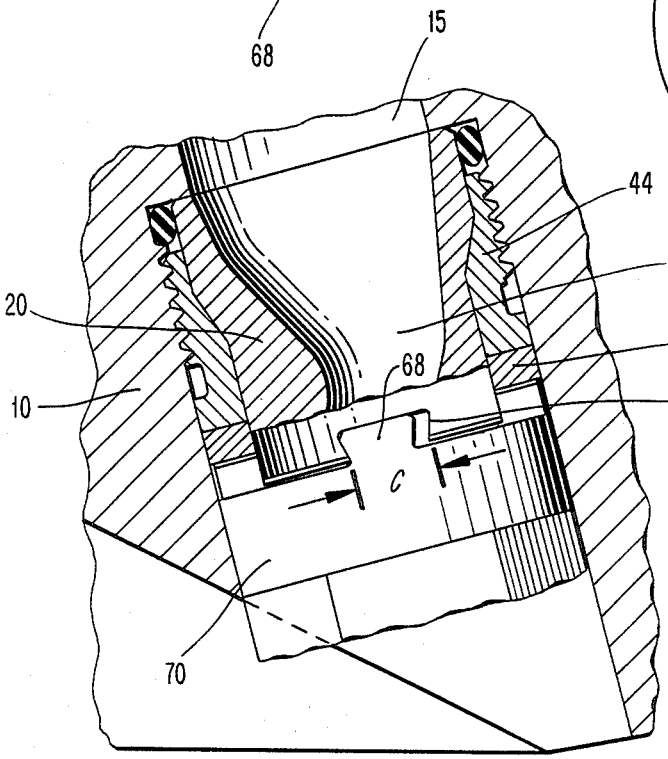
Fig. 8

ORIENTABLE FLUID NOZZLE FOR DRILL BITS

BACKGROUND OF THE INVENTION

The present invention relates to subterranean drilling and, in particular, to fluid ejecting nozzles utilized in connection with such drill bits.

In a typical rotary drilling operation, a rotary drill bit is rotated while being advanced into a soil or rock formation. The soil or rock is cut by cutting elements on the drill bit, and these cuttings are flushed to the top of the borehole by the circulation of drilling fluid. The drilling fluid is delivered downwardly through a passage in the drill stem and is ejected outwardly through nozzles threadedly connected in the face of the drill bit. The ejected drilling fluid also cleans and cools the cutting elements.

The nozzles are located proximate the bottom of the borehole and are subjected to the action of abrasive particles moving at high speeds in that region. As a result, the nozzles may eventually be abraded to the point where they fall out or must be replaced. That problem can be alleviated to some extent by forming the nozzle of a hard, wear-resistant material such as cemented tungsten carbide. However, it is difficult to form screw threads in such a hard material. Therefore, it has been proposed to form screw threads in a softer material such as a steel sleeve, and then bond the sleeve to the nozzle body, as disclosed in U.S. Pat. No. 4,381,825 for example. In U.S. Pat. No. 4,542,798 there is disclosed a threaded sleeve which is bonded to a tungsten carbide body to form therewith a locknut which secures a separate nozzle body in place. A shortcoming of the nozzles disclosed in the two above-referenced patents is that they cannot be utilized in connection with nozzles of the orientable type, i.e., the type in which the direction or pattern of the fluid stream can be altered by rotation of the nozzle. Such nozzles are advantageous because it is possible to improve the cleaning and cooling functions (and thus improve the drilling rate) by means of a particular orientation of the fluid streams with respect to the diamond cutting elements.

An orientable nozzle is disclosed in U.S. Pat. No. 4,533,005 wherein the threads are formed in a steel split ring. The ring is mounted on a nozzle body so as to be rotatable relative thereto. The nozzle body and threaded ring include sets of apertures which can receive a wrench. By inserting the wrench into both sets of apertures simultaneously, the threaded sleeve can be rotated and secured in the drill bit body. Afterwards, the wrench can be partially withdrawn so as to engage only the apertures of the nozzle body, thereby enabling the nozzle body to be rotated and reoriented. In this way it is possible to properly direct the direction of the fluid streams. Notwithstanding the advantages of such a nozzle structure, room for improvement remains. For example, it would be desirable to prevent abrasion of the softer sleeve material by particles passing through the apertures of the nozzle body. Also, it would be more desirable if the sleeve were a circumferential continuous member, rather than a split member.

SUMMARY OF THE INVENTION

The present invention involves a nozzle for a drill bit. The nozzle comprises a nozzle body and a securing ring. The nozzle body has a fluid passage extending rear-to-front therethrough. The nozzle body is formed of a wear-resistant material and includes a first abutment surface. The securing ring secures the nozzle body in a threaded hole of the drill bit. The securing ring comprises an externally threaded sleeve and a cap bonded to the sleeve. The sleeve is rotatable on an outer periphery of the nozzle body about a longitudinal axis of the nozzle body. The sleeve is formed of a softer material than the nozzle body. The cap is bonded to a front longitudinal end surface of the sleeve to cover that surface. The cap is formed of a wear-resistant material harder than the material of which the sleeve is formed. The cap includes a front end surface which is engageable by a tool for enabling the securing ring to be rotated relative to the nozzle body about the longitudinal axis. The securing ring includes a second abutment surface arranged to engage the first abutment surface of the nozzle body for displacing the nozzle body longitudinally as the securing ring is threaded into the cavity of the drill bit.

Preferably, the fluid passage is of the type which is orientable in response to rotation of the nozzle body about the longitudinal axis of the nozzle body.

BRIEF DESCRIPTION OF THE DRAWINGS

The advantages of the invention will become apparent from the following detailed description of a preferred embodiment thereof in connection with the accompanying drawings, in which like numerals designate like elements, and in which:

FIG. 1 is a side elevational view of a drill bit, with a portion thereof broken away to expose a nozzle according to the present invention;

FIG. 2 is a longitudinal sectional view taken through the nozzle;

FIG. 3 is a front end view of the nozzle;

FIG. 4 is an exploded view of the nozzle;

FIG. 5 is a side elevational view of a wrench for installing and removing the nozzle, with a portion of the wrench broken away;

FIG. 6 is a front end view of the wrench;

FIG. 7 is a rear end view of the wrench; and

FIG. 8 is a longitudinal sectional view taken through the nozzle as the nozzle is being inserted into a cavity of a drill bit by means of the wrench.

DETAILED DESCRIPTION OF A PREFERRED EMBODIMENT OF THE INVENTION

Depicted in FIG. 1 is a rotary drill bit 10 mounted at the end of a drill stem (not shown). A plurality of cutting elements 12 are fastened in the face of the drill bit for cutting away a rock or earth formation as the drill bit is rotated.

A plurality of nozzles 16 is mounted in the face of the drill bit for discharging high-speed jets of drilling fluid against the bottom of the borehole being cut. The drilling fluid is conducted to the nozzles through a passage 14 in the drill stem which communicates with bore-type cavities 15 in the drill bit. The nozzles 16 are threadedly secured at the outer ends of the cavities 15 and include discharge or jet openings 18 through which the drilling fluid is discharged. The discharged fluid cleans and cools the cutting elements 12 and carries cuttings to the top of the borehole in the annular spaced between the drill stem and the borehole wall.

In accordance with the present invention, each nozzle 16 comprises nozzle body 20 and a securing ring 22 for securing the nozzle body in place. The fluid passage 18 in the nozzle body 20 is of the type which is non-symmetrical relative to a longitudinal axis L of the nozzle whereby the passage can be oriented in response to rotation of the nozzle body. That is, the passage 18 may direct a stream of fluid in a direction D angled relative to the longitudinal axis L of the nozzle, which direction is changed when the nozzle body is rotated. Alternatively, or additionally, the passage could be aligned with the axis L but have a non-circular cross-section whereby the flow pattern is altered in response to rotation of the nozzle body. As is evident, the preferred embodiment contains both features, i.e., the direction D is angled relative to the axis L and the cross-section of the passage 18 is oblong shaped.

The nozzle body 20 is formed of a hard wear-resistant material such as cemented tungsten carbide for example, so as to be resistant to erosion during a drilling operation. A front portion of the nozzle body has a circular outer periphery 24 of smaller outer diameter than a circular outer periphery 26 of a rear portion of the nozzle body. An inclined transition surface or step 28 interconnects the two peripheries 24, 26, the step being oriented obliquely relative to the longitudinal axis L.

The fluid passage 18 in the nozzle body includes an inlet portion 30 and an outlet portion 32, the latter being of oblong cross-section. The inlet portion has a cross-sectional area which progressively diminishes as it approaches the outlet portion 32. The outlet portion has a constant cross-sectional area.

The major sides 34, 36 of the outlet portion are parallel and disposed at an acute angle A, preferably 30°, relative to the longitudinal axis L of the nozzle body. One of the major sides 30 of the inlet portion 30 extends at an acute angle, preferably 10° relative to the axis L, and the other major side 40 of the inlet portion extends at a larger acute angle, preferably 30°, relative to the axis L. A rear end 42 of that side 40 is inclined by a smaller angle relative to the axis L. It will be appreciated that fluid exits the nozzle with an oblong shape and travels in a direction D disposed at an acute angle, preferably 30°, relative to the axis.

The securing ring 22, which comprises a threaded sleeve 44 and a cap 46 bonded thereto, is mounted on the outer peripheral surface of the nozzle body 20 so as to be rotatable relative thereto. An outer cylindrical surface of the sleeve 44 is formed with screw threads 48 which are adapted to be threadedly received by internal treads in the cavity 15 of the drill bit. An annular channel 50 in the sleeve outer, periphery is adapted to receive an O-ring seal 52.

An inner surface or periphery of the sleeve is shaped complementarily to the outer surface of the nozzle body. That is, the sleeve inner surface includes a front portion 54 of smaller diameter than a rear portion 56, and an inclined step 58 interconnecting those two surface portions 54, 56. The dimensions of the sleeve inner surface are closely matched to those of the outer surface of the nozzle body so that the sleeve is freely rotatable on the nozzle body with relatively little play. The inclined steps 28, 58 constitute abutment surfaces disposed rearwardly of a front end 37 of the nozzle which enable the sleeve to displace the nozzle body into the cavity 15 when the sleeve is screwed into the cavity.

The sleeve 48 is formed of a softer material than the nozzle body to facilitate the cutting of the screw threads therein. For example, the sleeve can be formed of steel.

The cap 46 includes a rearwardly facing rearmost end 61 which is bonded to a forward facing front end surface 60 of the sleeve, e.g., by brazing, so as to completely overlie and cover that front end surface and shield it from abrasive particles. The cap comprises a circular cylindrical disk having an inner peripheral surface 62 with a diameter corresponding to the inner diameter of the front portion 54 of the sleeve. An outer surface 64 of the disk has a diameter corresponding to an outer diameter of the front end surface 60 of the sleeve, the latter diameter corresponding to the outer diameter of the threads 48. The smallest diameter of the rear end 61 is no smaller than the diameter of the front end of the outer periphery 26 of the nozzle body. When the abutment surfaces 28, 58 are in mutual engagement, the rear end 61 of the cap is disposed rearwardly of the front end of the nozzle body and the cap is rotatable on the outer periphery of the nozzle body.

The front end surface 63 of the cap contains a plurality of slots 66 (e.g., four) adapted to receive complementarily shaped projections 68 on a tool such as a wrench 70 (FIGS. 5 and 6) to enable an operator to rotate the cap and sleeve by means of the wrench. The slots are of dove-tail configuration, i.e., the side surfaces 72 of the slot are undercut in a longitudinal direction. The side surfaces 74 of the wrench projections 68 are also of dove-tail shape, but on a smaller scale. That is, the maximum width B, i.e., the maximum circumferential dimension, of each projection is smaller than the width C of the mouth of each slot 66 to enable the projections to be inserted longitudinally into the slots. When the wrench is thereafter rotated, a side surface 74 of each projection 68 engages a side surface 72 of its associated slot 66 as depicted in FIG. 8, to impart rotation to the ring 22. Due to the undercut configuration of the slot 66, inadvertent longitudinal dislodgement of the projections 68 from the slots 66 is resisted. That is, dislodgement of the projections can only be effected after centering the projections in the slots in a circumferential direction, and thus cannot be effected while the wrench is in the process of rotating the ring 22.

The end of the wrench opposite the projections 68 is provided with a non-circular, preferably hexagonal, socket 80 for receiving a correspondingly configured tongue of a turning tool (not shown).

To install the nozzle, the ring 22 is mounted on the nozzle body and that assembly is positioned for insertion into a cavity 15 of a drill bit. The nozzle body is rotated so that the passage 18 is disposed in its desired final orientation. By then rotating the ring by means of the tool 70, the sleeve is threaded into the cavity, thereby securing the nozzle body into the cavity.

The present invention enables an orientable nozzle to be effectively installed in place in proper orientation and assures that the softer material of the sleeve is shielded from abrasive wear during a drilling operation. The invention also includes a tool for rotating the nozzle with little risk of being accidentally dislodged from the nozzle.

The present invention is preferably utilized in connection with nozzle bodies of the orientable type, but could also be utilized in connection with nozzle bodies which are non-orientable, i.e., wherein the fluid exits the nozzle with a circular cross-section in alignment with the axis of the nozzle body.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What we claim is:

1. A nozzle for a drill bit, comprising:

a nozzle body formed of a wear-resistant material and defining a front-to-rear extending longitudinal axis, said body having a front-to-rear extending outer periphery and a front-to-rear extending fluid passage disposed therein, said outer periphery including a first abutment surface disposed rearwardly of a front end of said outer periphery, and a securing ring for securing said nozzle body in an internally threaded hole of a drill bit, comprising:

an externally threaded sleeve formed of a softer material than said nozzle body and having a front-to-rear extending inner periphery mounted on said outer periphery for rotation about said longitudinal axis, said inner periphery including a second abutment surface disposed rearwardly of a forwardly facing forwardmost end of said sleeve and engageable with said first abutment surface, said forwardly facing forwardmost end of said sleeve disposed rearwardly of a forwardmost end of said body outer periphery when said first and second abutment surfaces are in mutual engagement, and an annular cap formed of a material harder than said sleeve and including a front-to-rear extending inner periphery and a rearwardly facing rearwardmost end which is bonded to said forwardmost end of said sleeve, the smallest inner diameter of said rearwardmost end being no smaller than the greatest diameter of said front end of said body outer periphery, such that when said first and second abutment surfaces are in mutual engagement said rearwardmost end of said cap is disposed rearwardly of said front end of said body outer periphery and said inner periphery of said cap is rotatable on said body outer periphery, said cap including a front end surface having means engageable by a tool for enabling said securing ring to be rotated relative to said nozzle body about said longitudinal axis such that said second abutment surface engages said first abutment surface for displacing said nozzle body longitudinally as said securing ring is threaded into a hole of a drill bit.

2. A nozzle according to claim 1, wherein said means engageable by a tool comprises a plurality of slots formed in said front end surface of said cap, said slots being longitudinally undercut to resist longitudinal dislodgement of complementarily configured projections on the tool.

3. A nozzle according to claim 2, wherein said slots are of dove-tail configuration.

4. A nozzle according to claim 1, wherein said fluid passage is configured non-symmetrically relative to said longitudinal axis such that the orientation of ejected fluid relative to said axis changes in response to rotation of said nozzle body about said longitudinal axis.

5. A nozzle according to claim 4, wherein said sleeve includes a channel in an outer periphery thereof for carrying an 0-ring seal.

6. A nozzle according to claim 4, wherein each of said first and second abutment surfaces is oriented at an acute angle relative to said longitudinal axis.

7. A nozzle according to claim 1, wherein said front end surface of said cap lies substantially flush with said front end of said outer periphery of said nozzle body when said first and second abutment surfaces are in mutual engagement.

* * * * *